US008159836B2

(12) United States Patent
Pizzi

(10) Patent No.: US 8,159,836 B2
(45) Date of Patent: Apr. 17, 2012

(54) MULTI-LAYER CONDUCTOR BODY AND METHOD FOR THE PRODUCTION THEREOF

(75) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 383 days.

(21) Appl. No.: 12/419,271

(22) Filed: Apr. 6, 2009

(65) Prior Publication Data

US 2009/0257214 A1 Oct. 15, 2009

(30) Foreign Application Priority Data

Apr. 15, 2008 (IT) ..... MI2008A0674

(51) Int. Cl.
*H01R 4/58* (2006.01)

(52) U.S. Cl. ..... 361/823; 361/828; 361/633; 361/637; 439/59; 439/79; 439/212; 439/884; 310/216.048

(58) Field of Classification Search ..... 361/633, 361/637, 601, 605, 611, 629, 638, 673–675, 361/822–828; 439/79, 717, 212, 884; 29/830–836, 29/592, 598; 310/214, 216.048, 216.064; 174/17 CT, 524, 527, 530, 549, 68.2, 71 B, 174/70 C, 106 R, 120 R
See application file for complete search history.

(56) References Cited

U.S. PATENT DOCUMENTS 945,017 A 1/1910 Cole
2,045,847 A 6/1936 Fotsch
2,082,947 A 6/1937 Fotsch
2,884,613 A * 4/1959 Chandler et al. ..... 439/717
2,900,618 A 8/1959 Geier
3,159,730 A 12/1964 Staffel
3,400,303 A * 9/1968 Rowlands et al. ..... 361/637
3,609,642 A 9/1971 Norden
3,665,376 A 5/1972 Paris et al.
3,751,579 A 8/1973 Nojiri
3,775,733 A 11/1973 Ege
3,840,781 A 10/1974 Brown
4,070,086 A 1/1978 Trafford
4,130,331 A 12/1978 Neff et al.
4,160,182 A * 7/1979 Mitsui ..... 310/214
4,171,861 A 10/1979 Hohorst
(Continued)

FOREIGN PATENT DOCUMENTS

DE 1842868 U 12/1961
(Continued)

OTHER PUBLICATIONS

European Search Report from EP08075059, dated, Aug. 24, 2009.

*Primary Examiner* — Michail V Datskovskiy
(74) *Attorney, Agent, or Firm* — Mintz, Levin, Cohn, Ferris, Glovsky and Popeo, P.C.

(57) ABSTRACT

Conductor body comprising a first outer component extending in the longitudinal direction and provided with at least one tooth projecting in the transverse direction from the inner surface, the tooth having an inner recess; at least one middle component having a mating recess and tooth, the same as the outer component; a closing component provided with at least one opening able to engage with the at least one tooth of the middle component, wherein each of the components are packed together in a transverse direction so as to form a multi-layer body.

13 Claims, 3 Drawing Sheets

U.S. PATENT DOCUMENTS

| | | | | |
|---|---|---|---|---|
| 4,203,200 | A | 5/1980 | Wiebe | |
| 4,224,592 | A | 9/1980 | Urani et al. | |
| 4,241,975 | A | 12/1980 | Cooper, Jr. | |
| 4,330,164 | A | 5/1982 | Pittman et al. | |
| 4,340,270 | A | 7/1982 | Wilmes et al. | |
| 4,350,407 | A | 9/1982 | Tong | |
| 4,365,396 | A | 12/1982 | Baba et al. | |
| 4,391,485 | A | 7/1983 | Urani | |
| 4,444,455 | A | 4/1984 | Wiancko et al. | |
| 4,559,504 | A | 12/1985 | Krec | |
| 4,693,533 | A | 9/1987 | Szczesny et al. | |
| 4,795,997 | A | 1/1989 | Fisher et al. | |
| 4,889,504 | A | 12/1989 | Barbier et al. | |
| 4,921,450 | A | 5/1990 | Herbert | |
| 4,940,431 | A | 7/1990 | Hennemann | |
| 4,979,285 | A * | 12/1990 | Martin | 29/598 |
| 5,002,505 | A | 3/1991 | Jones et al. | |
| 5,030,131 | A | 7/1991 | Boehm | |
| 5,075,150 | A * | 12/1991 | Webb et al. | 428/162 |
| 5,142,178 | A * | 8/1992 | Kloster et al. | 310/216.048 |
| 5,243,139 | A | 9/1993 | Law | |
| 5,276,280 | A | 1/1994 | Ball | |
| 5,328,392 | A | 7/1994 | Lin et al. | |
| 5,338,996 | A * | 8/1994 | Yamamoto | 310/216.048 |
| 5,406,243 | A * | 4/1995 | Jenkins et al. | 336/217 |
| 5,454,730 | A | 10/1995 | Tozuka | |
| 5,553,787 | A | 9/1996 | Guginsky | |
| 5,564,941 | A | 10/1996 | Norden | |
| 5,766,044 | A | 6/1998 | Norden | |
| 5,853,304 | A | 12/1998 | Landreau et al. | |
| 5,860,837 | A | 1/1999 | Bock et al. | |
| 5,905,230 | A | 5/1999 | Marik | |
| 5,915,998 | A | 6/1999 | Stidham et al. | |
| 6,004,167 | A | 12/1999 | Hirakawa | |
| 6,009,607 | A * | 1/2000 | Bertocchi et al. | 29/33 K |
| 6,157,287 | A | 12/2000 | Douglass et al. | |
| 6,238,225 | B1 * | 5/2001 | Middlehurst et al. | 439/212 |
| 6,475,038 | B1 | 11/2002 | Franck | |
| 6,786,779 | B2 | 9/2004 | Feldmeier et al. | |
| 7,101,231 | B2 | 9/2006 | Prokup et al. | |
| 7,104,812 | B1 * | 9/2006 | Bogiel et al. | 439/79 |
| 7,385,518 | B2 | 6/2008 | Torrez et al. | |
| 7,413,486 | B2 | 8/2008 | Pizzi | |
| 7,438,606 | B2 | 10/2008 | Pizzi | |
| 7,500,889 | B2 | 3/2009 | Pizzi | |
| 2002/0067279 | A1 | 6/2002 | Torrez et al. | |
| 2005/0042912 | A1 | 2/2005 | Drewes et al. | |
| 2005/0221665 | A1 | 10/2005 | Otto et al. | |
| 2006/0128232 | A1 | 6/2006 | Kim | |
| 2006/0148302 | A1 | 7/2006 | Patel et al. | |
| 2006/0189222 | A1 * | 8/2006 | Bogiel et al. | 439/884 |
| 2006/0228950 | A1 | 10/2006 | Jamaleddin et al. | |
| 2007/0004291 | A1 * | 1/2007 | Bogiel et al. | 439/884 |
| 2007/0159292 | A1 | 7/2007 | Chang et al. | |
| 2008/0242150 | A1 | 10/2008 | Chikamatsu et al. | |

FOREIGN PATENT DOCUMENTS

| | | | |
|---|---|---|---|
| DE | 2914192 | A1 | 10/1980 |
| DE | 3339365 | A1 | 5/1985 |
| DE | 3621071 | A1 | 1/1987 |
| DE | 3629796 | C1 | 12/1987 |
| DE | 3805158 | A1 | 8/1989 |
| DE | 4223540 | A1 | 1/1994 |
| DE | 4231244 | A1 | 3/1994 |
| DE | 4409612 | A1 | 9/1994 |
| DE | 19530947 | A1 | 1/1997 |
| DE | 19542628 | C1 | 2/1997 |
| DE | 19729327 | C1 | 10/1998 |
| DE | 29821558 | U1 | 3/1999 |
| DE | 29921080 | | 4/2001 |
| DE | 10010719 | C1 | 8/2001 |
| DE | 20303475 | U1 | 5/2003 |
| DE | 10324144 | A1 | 2/2005 |
| DE | 102004018553 | A1 | 11/2005 |
| DE | 202005005369 | U1 | 3/2006 |
| DE | 102008009986 | A1 | 7/2009 |
| EP | 0382999 | | 8/1990 |
| EP | 0678934 | A1 | 10/1995 |
| EP | 0893859 | A2 | 1/1999 |
| EP | 1137034 | A1 | 9/2001 |
| EP | 1137035 | A1 | 9/2001 |
| EP | 1381068 | A1 | 1/2004 |
| EP | 1531522 | A1 | 5/2005 |
| EP | 1536519 | A1 | 6/2005 |
| EP | 1630903 | A1 | 3/2006 |
| EP | 1798821 | A2 | 6/2007 |
| EP | 1860738 | A1 | 11/2007 |
| EP | 1887658 | A2 | 2/2008 |
| FR | 1593558 | A | 6/1970 |
| FR | 2259462 | A1 | 8/1975 |
| FR | 2529024 | A1 | 12/1983 |
| FR | 2637740 | A1 | 4/1990 |
| FR | 2766628 | A1 | 1/1999 |
| GB | 2342508 | A | 4/2000 |

* cited by examiner

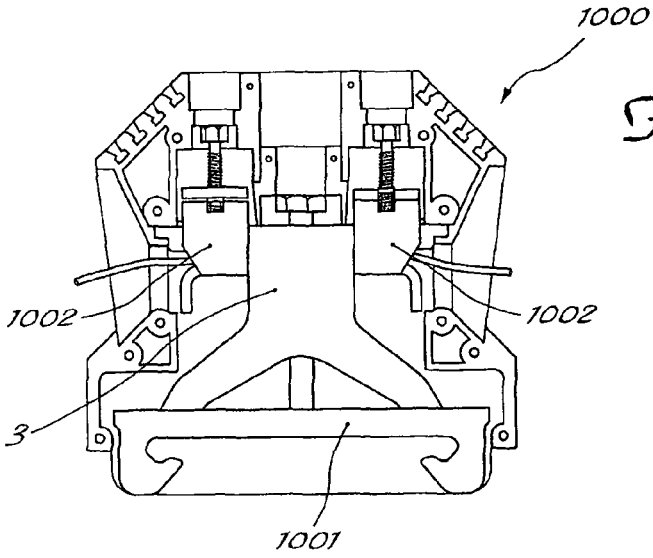
Fig.5
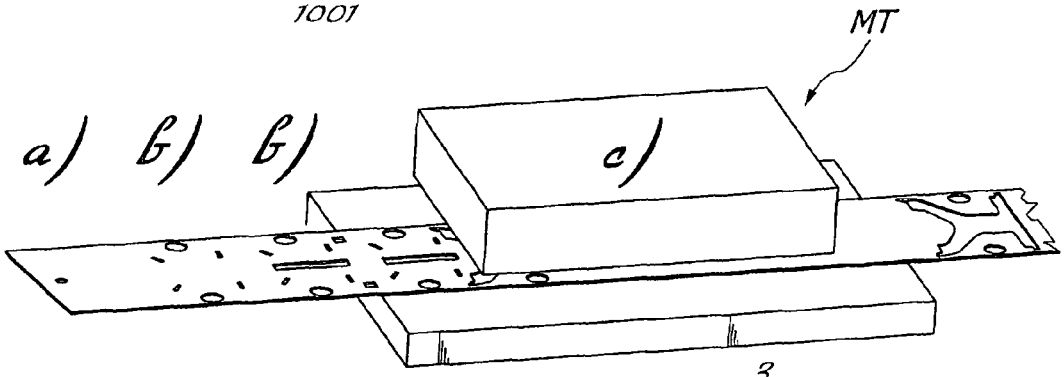
Fig.6
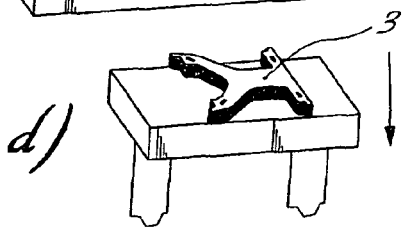
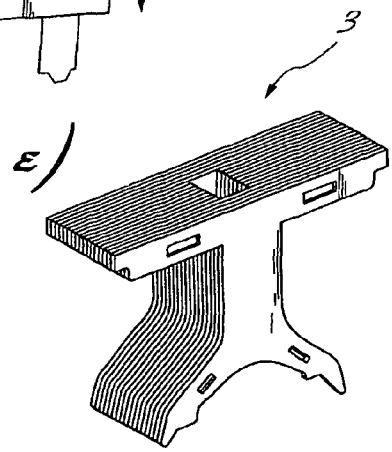
Fig.7
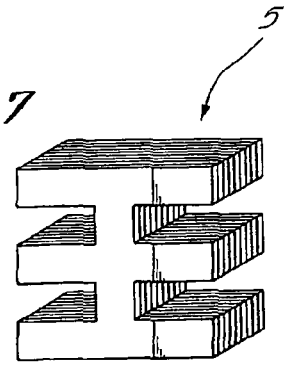

MULTI-LAYER CONDUCTOR BODY AND METHOD FOR THE PRODUCTION THEREOF

TECHNICAL FIELD OF THE INVENTION

The present invention relates to a multi-layer conductor body.

DESCRIPTION OF THE PRIOR ART

It is known, in the technical sector relating to electrical connection devices such as terminal strips, connection boxes and the like, to use terminal blocks designed to be mounted on corresponding supports and provide frontal access to the means—normally of the screw type—for retaining the electrical connection wires which form the electric circuit.

It is also known that the means for retaining the end of the electric wire are normally designed with so-called "sliders", movable in a direction perpendicular to the direction in which the wire is inserted, upon tightening a screw which causes retraction of the slider so as to grip the wire between the slider itself and a counter plate extending parallel to the wire and designed to ensure the electrical continuity of the circuit inside the device.

Said sliders are electrically connected together inside the terminal block by means of a conducting part (or so-called "internal bus") which must have a thickness and cross-section suitable for the rated electrical load, portions for connecting the terminal blocks, and parts for mechanical engagement with the fixed rail of the switchboard in the case of an earth connection.

Also known for this purpose are particular forms of said parts which, although being functional, nevertheless have drawbacks arising from the fact that they must be made as one piece by means of a moulding, drawing or pressure die-casting process which provides a rough-formed part which must be finished by means of machining in order to provide the finished part which can be mounted in the terminal block.

Although fulfilling their function, these known processes and components nevertheless have the drawback that they have a complex design and require further machining of the part, with a consequent increase in the production waste, and therefore have a high unit cost which is incompatible with the requirement for high-volume mass production which is typical of the sector.

In addition the need to produce parts with a different thickness and cross-section depending on the various current loads requires the provision of a corresponding number of machines, increasing the costs of the finished part.

SUMMARY

The technical problem which is posed, therefore, is that of providing a conductor body to be used in a wide variety of sectors and able to be designed with forms, dimensions and a finish suitable for the final use, without the need for further machining of the part.

In connection with this problem, it is also provided that this body should be easy and inexpensive to mass-produce by means of a method which is able to provide the finished part employing substantially continuous production steps.

These results are achieved according to the present invention by a multi-layer body according to the characteristic features of the invention.

BRIEF DESCRIPTION OF THE FIGURES

Further details may be obtained from the following description of a non-limiting example of embodiment of the subject of the present invention provided with reference to the accompanying drawings in which:

FIG. 5 shows a plan view of a terminal block assembled with the conductor body according to the present invention;

FIG. 6 shows a schematic plan view of the production sequence using a strip of material fed to the production machine; and FIG. 7 shows a perspective view of a further embodiment of the conductor body according to the invention.

DETAILED DESCRIPTION

Figure 1A:
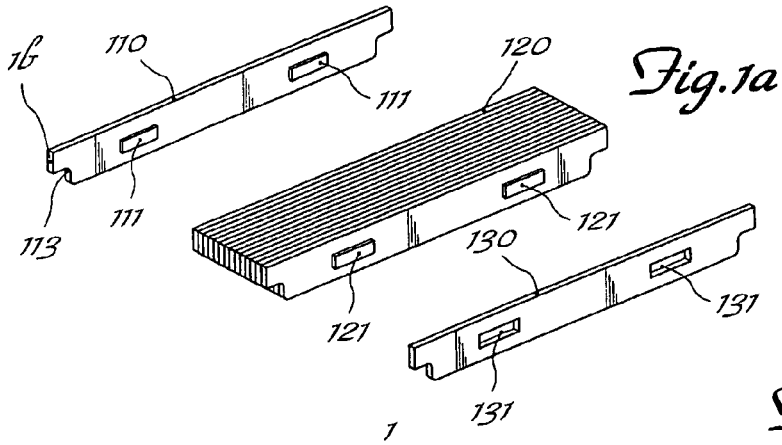
FIG. 1*a* shows an exploded view of a first embodiment of a multi-layer conductor body according to the present invention.

As shown in FIG. 1 and assuming solely for the sake of simplification of the description and without a restrictive meaning a set of three reference axes in a longitudinal direction X-X, transverse direction Y-Y and vertical direction Z-Z, the conductor body according to one embodiment of the present invention comprises:

a first outer component 110 extending in the longitudinal direction X-X and having at least one tooth 111 (two in the example shown in the figures) projecting inwards in the transverse direction Y-Y from the inner surface of the first outer component 110, the tooth can be formed by means of die-forming with displacement of material so as to form an inner recess 112 (FIG. 1*c*) opposite the tooth 111.

In the example shown the outer component 110 also has an incision 113 at each opposite end, the reference function 1*b* of which for positioning inside a switchboard terminal block 1000 will become clear below from the description of FIG. 5.

The conductor body further can include at least one middle component 120 which in the example of embodiment according to FIG. 1 is the same as the outer component 110 and a closing component 130 with at least one opening 131 (two in the example) able to engage with the at least one tooth 111 of the middle component 120.

Figure 1B:
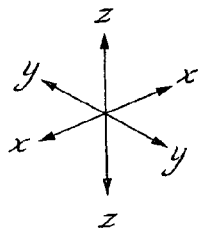
FIG. 1*b* shows a perspective view of the body according to FIG. 1*a* in the finished state.
Figure 1C:
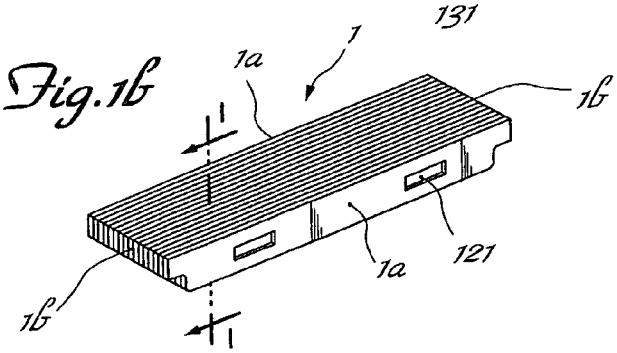
FIG. 1*c* shows a schematic cross-section along the plane indicated by the line I-I in FIG. 1*b;*

As shown in FIGS. 1*b* and 1*c*, once the various layers 110, 120 and 130 have been packed together so that each tooth 111, 121 engages inside the respective seat 112, 122 and the closing component 130 has in turn been fitted with its openings 131 mounted on the last projecting tooth 121, a finished, multi-layer, conductor body 1 is obtained, with both the end surfaces 1*a* flat, ready for final mounting.

It is pointed out, moreover, how it is possible to obtain the final thickness desired depending on the planned electric load by simply increasing the number of middle components 120, something which may be performed during the automatic assembly cycle without having to stop the machine for retooling thereof.

Figure 2A:
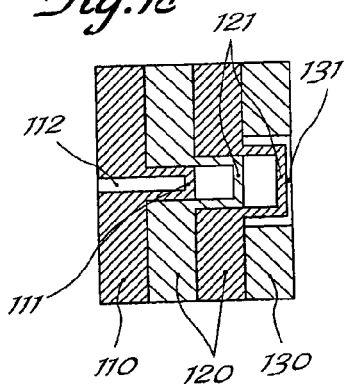
FIG. 2*a* shows an exploded view of a second embodiment of a multi-layer conductor body according to the present invention.
Figure 2A:
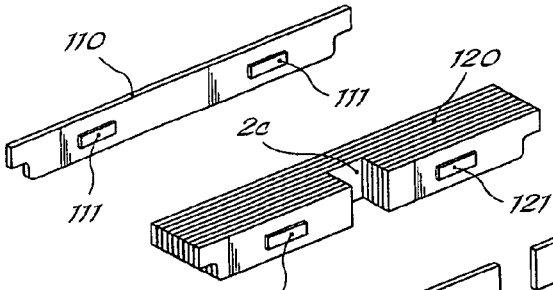
Figure 2B:
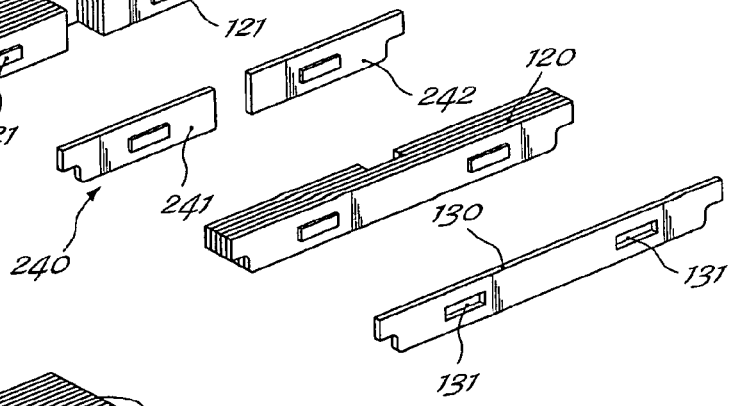
FIG. 2*b* shows a perspective view of the body according to FIG. 2*a* in the finished state.

FIGS. 2*a*, 2*b* show a second example of embodiment of the multilayer body according to the invention; in this embodiment of the invention, the finished body 2 includes a hole 2*c* (which is a through-hole in the example, but may also be a blind hole if required) for the insertion of a screw (not shown) in the vertical direction Z-Z; the body 2 is therefore formed by an outer component 110, by a plurality of middle components 120 which are the same as the outer component and by a plurality of second middle components 240 which are obtained during a shearing operation, with separation of the component 120 into two parts, 241 and 242, respectively, which are symmetrical with respect to the vertical axis Z-Z and removal of as much as material as is needed in order to determine the dimension of the hole in the longitudinal direction X-X and so as to form the two opposite end reference teeth 2*b*; the size of the hole in the transverse direction Y-Y being instead determined by the number of inserted second middle components 240 which, upon completion of packing, determine the thickness of the body and therefore the transverse dimension of the hole.

The multi-layer body 2 also comprises a further series of first middle bodies 120 for closing the hole in the transverse direction and achieving the final thickness envisaged for the said body (FIG. 2*b*) as well as the closing component 130 which is the same as the component according to FIG. 1*a*.

Figure 2C:
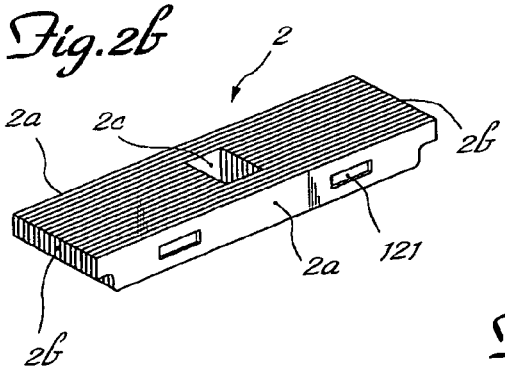
FIG. 2*c* shows a perspective view of a variant of the body according to FIG. 2*b;*
Figure 2C:
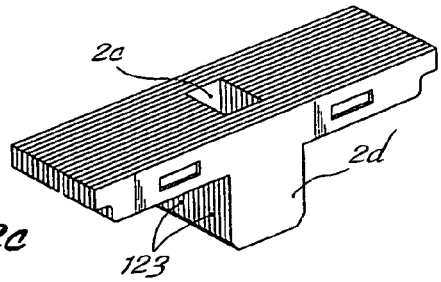

FIG. 2*c* shows a further variant of the body 2 which has a vertical extension 2*d* formed by a corresponding number of extensions 123 of each component part, so as to regain conducting cross-section, in particular in the case where the hole 2*c* is present, and therefore volume of current which may be directed through the conductor.

Figure 3A:
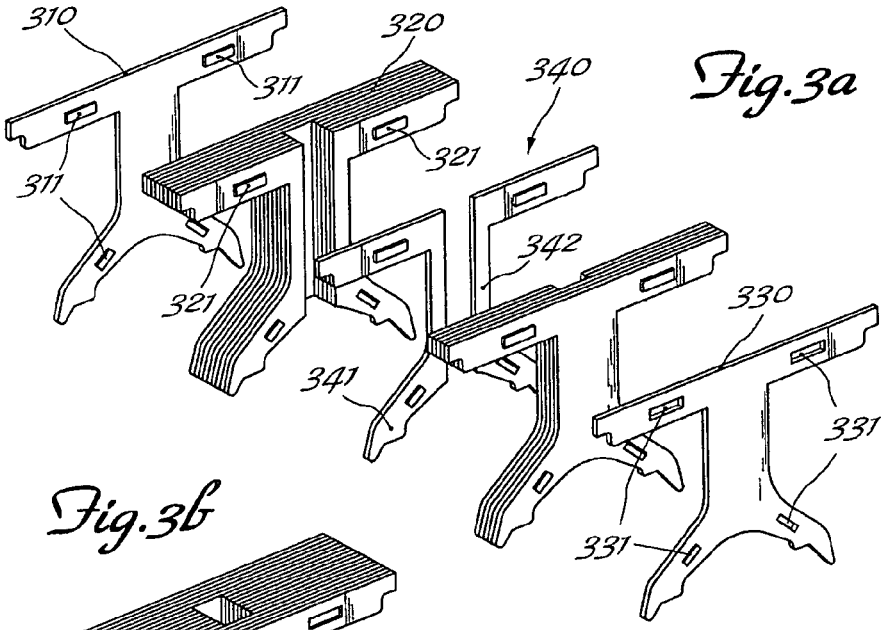
FIG. 3*a* shows an exploded view of a third embodiment of a multi-layer conductor body according to the present invention.
Figure 3B:
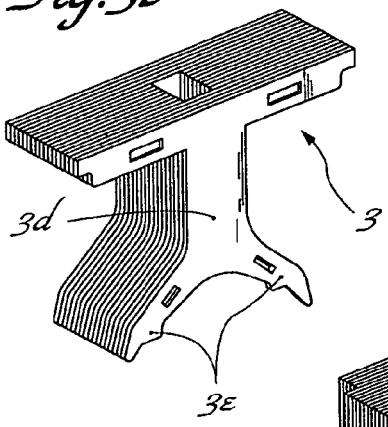
FIG. 3*b* shows a perspective view of the body according to FIG. 3*a* in the finished state.

As shown in FIGS. 3*a*-3*b* it is also possible to obtain a multi-layer body 3 extending in the vertical direction Z-Z (FIG. 3*b*), so as to form a central shank 3*d* provided with legs 3*e* splayed in the longitudinal direction so as to form the earth contact and designed to carry the engaging part 1001 of the switchboard terminal block 1000 (FIG. 5) for fixing to the DIN rail ensuring a third contact, while the screw-type sliders 1002 for fixing the conductor wires are mounted on the upper arms.

The wire fixing element can consist of springs instead of screw-operated sliders.

The component parts of this embodiment are similar to those already described and are therefore identified by corresponding reference numbers preceded by 3, a detailed description thereof being dispensed with.

Figure 4A:
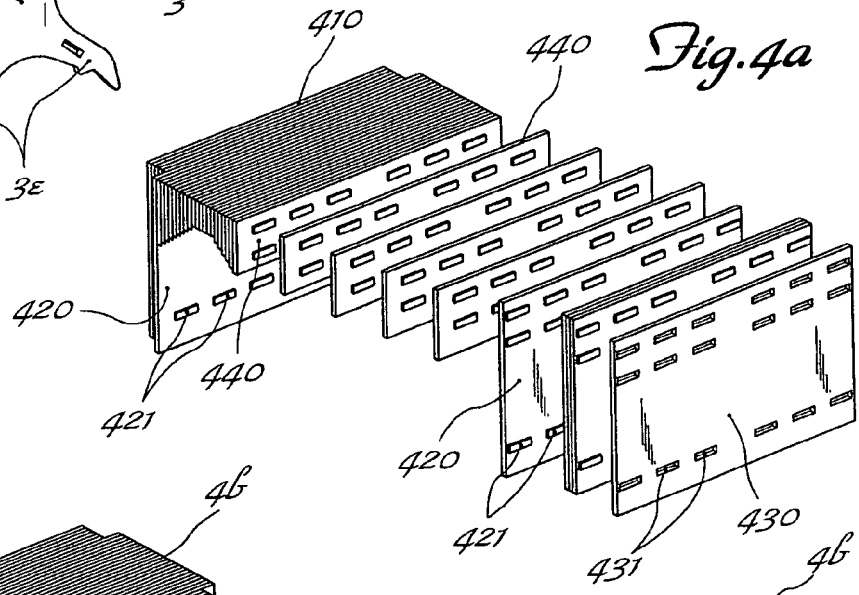
FIG. 4*a* shows an exploded view of a fourth embodiment of a multi-layer conductor body according to the present invention.
Figure 4B:
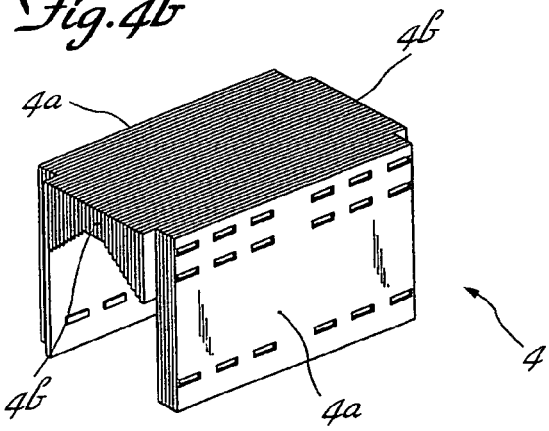
FIGS. 4*b*-4*c* show a perspective view of the body according to FIG. 4*a* in the finished state.
Figure 4C:
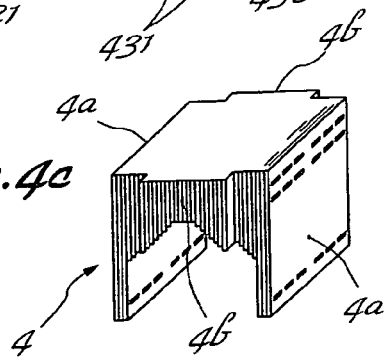

FIGS. 4*a*-4*c* show a further example of embodiment of a multi-layer conductor body 4 which in this case is bridge shaped so as to form a seat and a concave surface able to receive cables with a large cross-section, adapting to them and thus increasing the contact surface area and therefore the conduction capacity.

In this embodiment, the components are similar to those already described and are merely identified by numbers beginning with 4.

It is therefore clear how the multi-layer body according to the invention is suitable for being produced with a wide variety of forms and thicknesses, using a small number of different parts which need only be packed together in a different number in the transverse direction Y-Y in order to achieve the planned intended end result.

The present invention also includes a method for the production of multi-layer bodies in particular for electric terminal block conductors which can include the following steps:

a) providing of a flat strip N of suitable material extending in the longitudinal direction X-X and with a transverse dimension Y-Y corresponding to the longitudinal dimension of the finished body;

b) continuous feeding of the strip to a shearing machine MT;

c) starting the sequence for shearing the outer body component (110) and the middle body components (120);

d) separating the finished sequential component from the strip;

d) automatic packing in the vertical direction of the sheared outer body components (110) and middle body components (120) until the desired thickness is achieved;

e) shearing the closing body component (130);

f) packing the closing body component (130);

g) discharging the finished body.

As shown in FIG. 6, a fundamental step in the method is the automatic packing together of the various parts 110, 120, 130 detached from the strip at the station T+I for performing final shearing in the sequence; this station comprises a tray movable in the vertical direction and able to be lowered by an amount equal to the thickness of the packed part each time the component part is separated by means of shearing.

Thus the shearing stroke separates the finished component part, packs it together with the previous component part and causes lowering of the tray so as to prepare it for the next packing operation.

Once the programmed number of strokes for obtaining the finished conductor body has been reached, the latter is automatically discharged.

The conductor body is thus formed in a single continuous and totally automated cycle.

The sequence which determines the formation of the specific component part (110; 310; 410)-(120; 320; 420)-(130; 330; 430) may be programmed by means of corresponding control and actuating means which are conventional per se and therefore not described in detail.

It is therefore clear how with the shearing method according to the invention it is possible to provide multi-layer conductor bodies with programmed thicknesses, automatically, without the need for further machining of the part and retooling of the machine, it also being possible to obtain easily and at a low cost finished parts with a different form and dimensions, including the number of contact points which are required both symmetrically and asymmetrically as indicated by 5 in FIG. 7.

Although described in connection with certain constructional forms and certain preferred examples of embodiment of the invention, it is understood that the scope of protection present invention is defined solely by the following claims.

The invention claimed is:

1. A conductor body comprising:

a first outer component extending in a longitudinal direction and provided with at least one tooth projecting from an inner surface in a transverse direction, the tooth having an inner recess;

at least one middle component extending in a longitudinal direction and including at least one middle tooth projecting from a surface of the middle component in a transverse direction, the middle tooth forming an inner recess of sufficient size to receive the tooth of the first outer component;

a closing component having at least one opening adapted to engage the at least one middle tooth of the middle component;

an incision and a reference tooth located on at least one end of the conductor body;

wherein, the first outer component, one or more middle components and the closing component are packed together in the transverse direction so as to form a multilayer body.

2. A conductor body according to claim 1, further comprising a hole in a vertical direction suitable for insertion of a screw.

3. A conductor body according to claim 2, comprising a plurality of second middle components which are symmetrically arranged with respect to a vertical axis and spaced from each other in the longitudinal direction by a distance equal to a longitudinal dimension of the hole.

4. A conductor body according to claim 3, comprising a plurality of second middle components which determine a transverse dimension of the hole.

5. A conductor body according to claim 4, comprising a plurality of middle components arranged between the second middle components and the closing component.

6. A conductor body according to claim 4, comprising a vertical extension formed by a corresponding extension of each outer, middle and closing component.

7. A conductor body according to claim 6, comprising a central shank extending in the vertical direction and provided with legs splayed in the longitudinal direction.

8. A conductor body according to claim 1, having a bridge-shaped form.

9. A conductor body according to claim 1, further comprising a plurality of contact points extending from the conductor body.

10. Terminal block for switchboards, comprising a multilayer conductor body according to claim 1 housed inside it.

11. Terminal block according to claim 10, where the conductor body has a through-hole in the vertical direction suitable for insertion of a screw.

12. Terminal block according to claim 10, characterized in that the conductor body includes a central shank extending in the vertical direction and the central shank includes legs splayed in the longitudinal direction.

13. Terminal block according to claim 12, wherein said conductor body is coupled to the components for retaining conductor wires and to a hooking element for fastening the terminal block to a switchboard.

* * * * *